US010072493B2

(12) United States Patent
Flores et al.

(10) Patent No.: US 10,072,493 B2
(45) Date of Patent: Sep. 11, 2018

(54) HYDRAULIC INJECTION DIAGNOSTIC TOOL

(71) Applicant: BAKER HUGHES INCORPORATED, Houston, TX (US)

(72) Inventors: Juan C. Flores, The Woodlands, TX (US); Edward J. O'Malley, Houston, TX (US); Jason M. Harper, Cypress, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 1021 days.

(21) Appl. No.: 14/495,511

(22) Filed: Sep. 24, 2014

(65) Prior Publication Data

US 2016/0084072 A1 Mar. 24, 2016

(51) Int. Cl.

| | |
|---|---|
| ***E21B 47/06*** | (2012.01) |
| ***E21B 37/00*** | (2006.01) |
| ***E21B 33/126*** | (2006.01) |
| ***E21B 47/10*** | (2012.01) |

(52) U.S. Cl.

CPC ..... *E21B 47/06* (2013.01); *E21B 33/126* (2013.01); *E21B 37/00* (2013.01); *E21B 47/10* (2013.01); *E21B 47/1015* (2013.01)

(58) Field of Classification Search

CPC ..... E21B 33/124; E21B 33/126; E21B 37/00; E21B 43/26; E21B 47/06; E21B 47/10; E21B 47/1015

See application file for complete search history.

(56) References Cited

U.S. PATENT DOCUMENTS

| | | | | |
|---|---|---|---|---|
| 3,577,781 | A * | 5/1971 | Lebourg | E21B 47/06 166/264 |
| 4,426,086 | A * | 1/1984 | Fournie | E21B 33/126 277/309 |
| 4,648,448 | A * | 3/1987 | Sanford | E21B 23/006 166/187 |
| 5,261,487 | A * | 11/1993 | McLeod | E21B 33/126 166/196 |
| 5,743,334 | A * | 4/1998 | Nelson | E21B 49/008 166/250.07 |
| 7,284,606 | B2 | 10/2007 | Coronado | |
| 8,869,885 | B2 | 10/2014 | O'Malley | |

(Continued)

*Primary Examiner* — Robert E Fuller
*Assistant Examiner* — Christopher J Sebesta
(74) *Attorney, Agent, or Firm* — Mossman, Kumar & Tyler, PC

(57) ABSTRACT

An apparatus can include a conveyance device having a flow bore, an isolator forming a testing volume at least partially defined by an inner surface of a wellbore tubular, and one or more pressure sensors generating signals representative of a pressure in the testing volume while the conveyance device moves the isolator axially through the wellbore tubular. The isolator substantially isolates a testing fluid received from the flow bore in the testing volume from an adjacent bore of the wellbore tubular. A location of at least one flow path in the wellbore tubular is identified by estimating a pressure of the testing fluid in the testing volume. It is emphasized that this abstract is provided to comply with the rules requiring an abstract, which will allow a searcher or other reader to quickly ascertain the general subject matter of the technical disclosure.

19 Claims, 7 Drawing Sheets

(56) References Cited

U.S. PATENT DOCUMENTS

| | | | | |
|---|---|---|---|---|
| 2006/0000620 | A1* | 1/2006 | Hamilton | E21B 33/124 166/387 |
| 2010/0223990 | A1* | 9/2010 | Simpson | E21B 33/124 73/152.18 |
| 2010/0276160 | A1* | 11/2010 | Tolman | E21B 33/10 166/386 |
| 2011/0277996 | A1* | 11/2011 | Cullick | E21B 33/138 166/250.12 |

* cited by examiner

HYDRAULIC INJECTION DIAGNOSTIC TOOL

CROSS-REFERENCE TO RELATED APPLICATIONS

Background of the Disclosure

1. Field of the Disclosure

This disclosure relates generally to oilfield downhole tools and more particularly to methods and devices for performing a downhole operation.

2. Description of the Related Art

Wellbore operations such as drilling, wireline logging, completions, perforations and interventions are performed to produce oil and gas from underground reservoirs. Theses operations are done in a wellbore that can extend thousands of feet underground. Many operations require equipment to be placed at a specific depth. In some aspects, the present disclosure is directed to methods and devices for precisely locating malfunctions of the wellbore equipment and/or locating one or more subsurface features and positioning wellbore equipment.

SUMMARY OF THE DISCLOSURE

In one aspect, the present disclosure provides an apparatus for identifying flow paths during a downhole operation. The apparatus may include a conveyance device having a flow bore, an isolator forming a testing volume at least partially defined by an inner surface of a wellbore tubular, where the isolator substantially isolates a testing fluid received from the flow bore in the testing volume from an adjacent bore of the wellbore tubular, and at least one pressure sensor generating signals representative of a pressure in the testing volume while the conveyance device moves the isolator axially through the wellbore tubular.

In another aspect, the present disclosure provides a method of performing a downhole operation. The method may include forming a testing volume in a wellbore using an isolator, the testing volume being at least partially defined by an inner surface of a wellbore tubular and moving the testing volume along the wellbore while substantially isolating the testing volume from an adjacent bore of the wellbore tubular. The method also includes identifying a location of at least one flow path in a wellbore tubular by estimating a pressure of a testing fluid in the moving testing volume.

Illustrative examples of some features of the disclosure thus have been summarized rather broadly in order that the detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

For detailed understanding of the present disclosure, references should be made to the following detailed description of the preferred embodiment, taken in conjunction with the accompanying drawings, in which like elements have been given like numerals and wherein.

DETAILED DESCRIPTION OF THE DISCLOSURE

The present disclosure relates to an apparatus and methods for performing a downhole operation that involves identifying one or more downhole features such as fluid flow paths. These flow paths allow fluids to escape from the wellbore. Exemplary flow paths can include perforations, holes, openings, tunnels, cracks or other material imperfections or defects in or around a wellbore tubular.

In embodiments, these flow paths are identified by using a testing volume formed in a moving isolator. The pressure in this testing volume is continually monitored as the isolator is moved along the wellbore. A pressure drop, having a known characteristic, in the testing volume indicates that one or more flow paths have been encountered. Illustrative testing devices using a testing volume are described below.

Figure 1A:
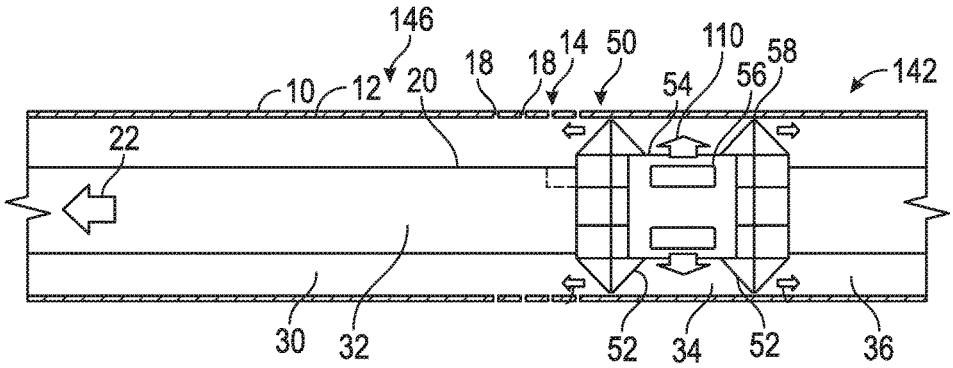
FIGS. 1A-1C show an exemplary isolator according to the present disclosure at different locations along a wellbore tubular.
Figure 1B:
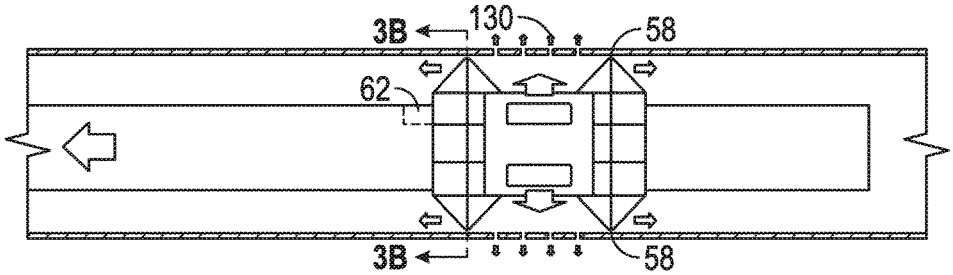
Figure 1C:
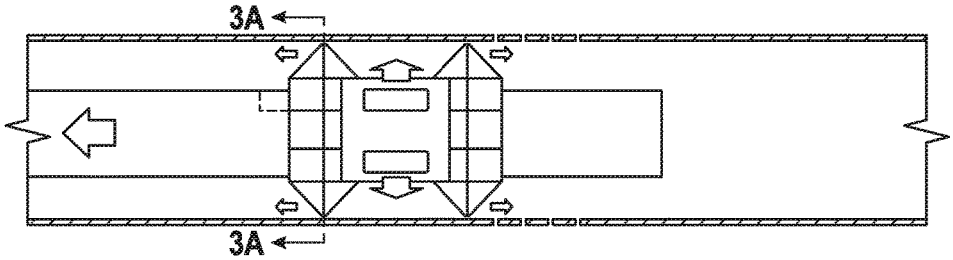

In one embodiment, the test device has a conveyance device, an isolator and one or more pressure sensors. FIG. 1A-1C show the isolator and the associated testing volume as it travels in the wellbore and encounters flow paths.

FIG. 1A shows an embodiment of the isolator 50 coupled to a conveyance device 20 run in a wellbore tubular or casing 10 disposed in a well. The conveyance device 20 has a flow bore 32 connected to a testing volume 34 delineated by the isolator 50 and the inner surface 12 of the casing 10. The testing volume 34 is filled with a testing fluid received from the flow bore 32. The isolator 50 substantially isolates the testing fluid in the testing volume 34 from the adjacent bores 30 and 36 of the casing 10 as the isolator 50 moves along the casing 10 from a location 142 to location 146.

FIG. 1B shows the isolator 50 at another depth, at a zone 14, along the casing 10. The testing volume 34 is aligned with one or more flow paths 18 in the casing 10 and fluidly connects some or all of the flow paths 18. The flow paths 18 provide escape routes for the testing fluid in the testing volume 34.

FIG. 1C shows the isolator 50, near a location 146, along the casing 10. The testing fluid is trapped similarly to the schema at the location 142 since none of the flow paths 18 face or surround the testing volume 34. There are no flow paths 18 that allow the fluid to leak from the testing volume 34.

Figure 2:
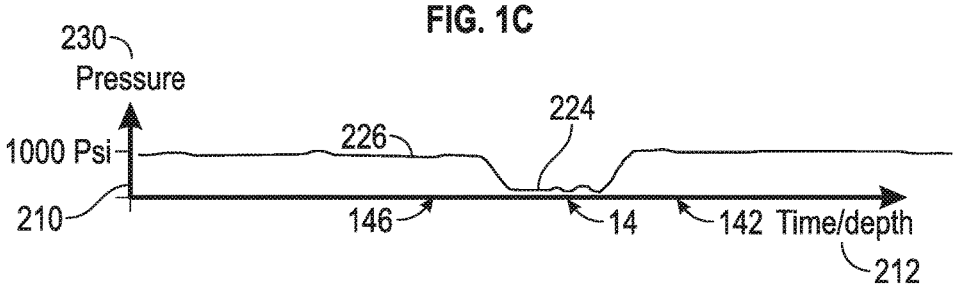
FIG. 2 shows a plot representing the estimated pressure drop of a testing fluid as the isolator of FIGS. 1A-C moves along the wellbore tubular.

FIG. 2 is a plot representing the estimated pressure drop of the testing fluid in the testing volume 34 at a measured depth as the isolator 50 moves from location 142 to location 146. The horizontal axis 212 shows depth. The vertical axis 210 indicates a testing volume pressure 230 in pounds per square inch (psi). The testing volume pressure 230 may be relative to the wellbore pressure, at the measured depth, or some other equipment pressure.

The plot has three segments: 222, 224 and 226. The plot section 222 illustrates the pressure of the testing volume as the isolator moves along location 142. Because there are no flow paths along location 142, the pressure is stable and results in a substantially horizontal plot line. At zone 14, the curve 224 starts dipping as the testing volume 34 encounters flow paths 18 as shown in FIG. 1B. As more of the testing volume 34 is exposed to the flow paths 18, the curve 224 gets progressively deeper. Eventually the curve 224 gets a profile that indicates that flow paths are the likely source of the pressure drop. This profile may have been determined through prior runs, jobs, experiments or logging (i.e., experimentally or analytically).

As the testing volume 34 leaves the treatment zone 14 behind as shown in FIG. 1C, the curve 224 ascends to a higher pressure value. At location 146, the isolator 50 is clear of the flow paths 18. Therefore, the plot section 226 again follows a horizontal line. In one embodiment, the plot sections 222 and 226 may indicate the same pressure. For instance, the testing volume pressure 230 may be 1000 psi.

In some embodiments, the testing volume 34 may be sealed when the isolator 50 is not connected to the flow paths 18. The seal is formed at the contact between an inner surface 12 of the casing 10 and the isolator 50. A diametrical gap between the isolator and the casing will be referred to as a "drift." A zero drift between the isolator 50 and the casing 10 is a perfect seal between the testing volume 34 and the adjacent bores 30 and 36. That is, no fluid escapes between the casing 10 and the isolator 50.

Figure 3B:
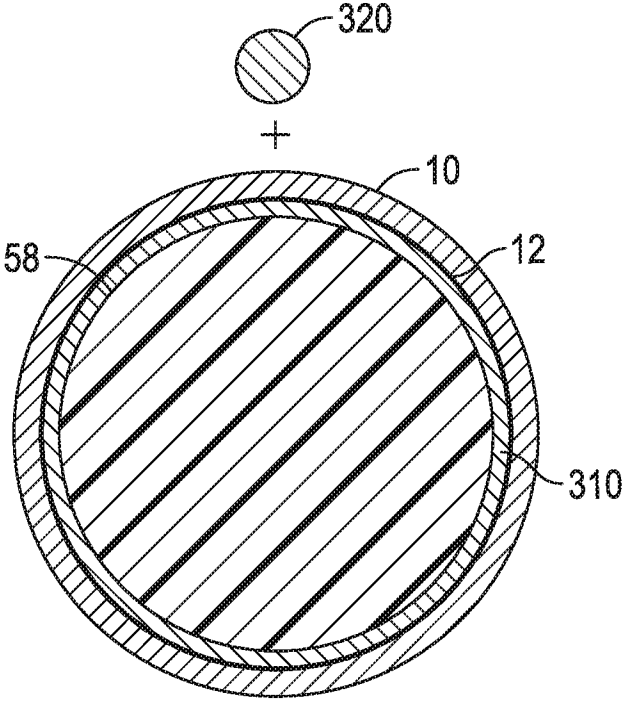
FIG. 3A-3B illustrates how fluid can escape from a testing volume associated with one embodiment of an isolator accordance to the present disclosure.
Figure 3A:
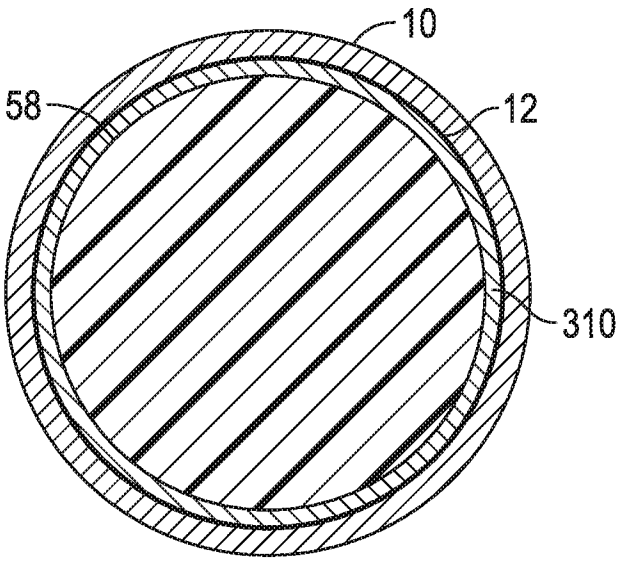

However, in many embodiments, it may not be possible to have a zero drift. Therefore, there will be a certain amount of fluid escaping into the adjacent bores 30 and 36. Still, the fluid isolation should be substantial enough to enable the detection of pressure drops in the testing volume that are caused by the flow paths. Determining an acceptable amount of fluid isolation is specific to the application. For example, fluid type, flow rate, casing size, number of flow paths and sizes affect fluid isolation design. FIGS. 3A-3B illustrate a methodology for estimating a gap that allows fluid escape from the testing volume.

FIG. 3A illustrates the testing fluid escape at a cross section of the casing 10 and the isolator 50 when the isolator 50 is at the locations 142 or 146 (FIGS. 1A and 1C). For ease in understanding, the conveyance device 20 and the flow bore 32 are not shown. The isolator 50 has an outer surface 58. The drift between the outer surface 58 and the inner surface 12 of the casing 10 provides a predetermined clearance 310. The testing fluid from the testing volume 34 escapes through the clearance 310 into the adjacent bores 30 and 36 (FIGS. 1A and 1C). Here, "predetermined" is used to represent an engineered calculation to have certain characteristics.

FIG. 3B illustrates testing fluid escape at a cross section of the casing 10 when the isolator 50 is at the zone 14. At the zone 14, not only the clearance 310, but also one or more flow paths 18 allow fluid to escape. In an illustrative case, each of the flow paths has an area providing a flow path area designated as 320. Therefore, at this cross section, the total fluid escape area is the total of the clearance 310 and the flow path area 320.

To discern the configuration in FIG. 3A from FIG. 3B, the total fluid escape area should change when the isolator 50 is fluidly connected the flow paths 18. Thus, the clearance 310 should be small enough and the flow path area 320 should be large enough to create the pressure drop.

As we mentioned before, the appropriate amount of isolation in the testing volume 34 is specific to the wellbore geometry to be treated. In one non-limiting example, an inner surface cross-sectional area of a casing 10 that has a 4.5 inch outer diameter and 16.6 pound per feet weight per length may be 11.07 square inches. If the diameter of the outer surface 58 is 3.63 inches, then the clearance 310 is 0.72 square inches between the outer surface 58 and the inner surface 12. Also, assuming there are six flow paths 18, each having 0.13 square inch area, aligned by the testing volume 34, the flow path area 320 is 0.78 square inches. Therefore, the total fluid escape area is estimated as 1.5 square inches (0.72 square inches+0.78 square inch2). If the test device cannot detect the pressure drop according to the parameters used, then the operator may choose to reduce the clearance, change the testing fluid, increase the testing fluid pump rate or the testing fluid pressure, etc.

Note that these values are provided with specificity merely for convenience and that the present invention is by no means limited to these values. Furthermore, it should be understood that these values are subject to applicable and practical casing 10, isolator 50, flow path 18 geometry characteristics and conditions.

Figure 4A:
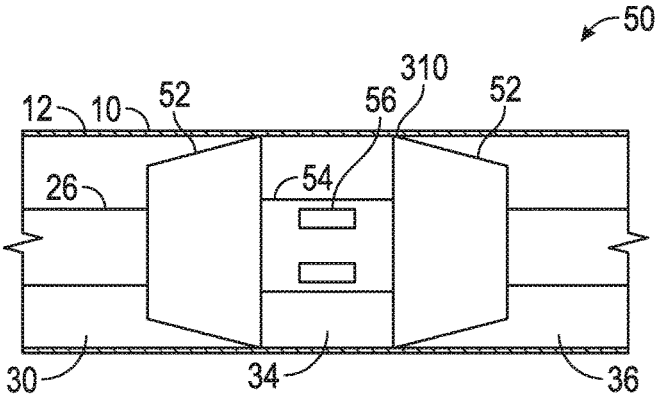
FIG. 4A-4C illustrates exemplary isolating members associated with an isolator according to the present disclosure.

It should be appreciated that the isolator 50 of the present disclosure is subject to various embodiments. One non-limiting embodiment will be described in reference to FIG. 4A. In FIG. 4A, the isolator 50 includes isolating elements 52, a mandrel 54, one or more ports 56. The isolating elements 52 are coupled to the mandrel 54. The outer surfaces 58 of the isolating elements 52 form the clearance 310. The isolating elements 52 substantially or completely isolate the testing fluid in the testing volume 34 and prevent the testing fluid from escaping to the adjacent bores 30 and 36.

In one embodiment, the testing volume 34 is delineated by the adjoining surfaces of the isolating members 52, the mandrel 54 and the casing 10. A port or multiple ports 56 disposed in the isolator 50 provide passage for the testing fluid from the flow bore 32 or an interior of the isolator 50 to the testing volume 34.

The isolating elements 52 may be a fixed cone, an expandable cone, a ring, a swab cup, a packer, a cylindrical compartment or any other seal. The first isolating element 52 may be different from the second isolating element 52 of the same isolator 50. The wear elements 420 may have a fixed dimension or may expand and retract by hydraulic, mechanical or electrical means. The isolator 50 may have more than two isolating elements 52. The distance between the isolating elements 52 may be equal to, or more or less than the length of a perforation cluster. A perforation cluster has a length corresponding to the distance between the ends of the perforation guns of the perforation tool used in the same or a previous job.

The isolator 50 may be connected to the conveyance device 20 through any suitable means. In one embodiment, the mandrel 54 is connected to the conveyance device 20 by a connector pipe 26. In another embodiment, the mandrel 54 may directly be assembled to the conveyance device 20. The conveyance device 20 may be a tubing, coiled tubing, drillpipe, wireline, slickline, electric line or a combination thereof, which provides the testing fluid to testing volume 34.

Figure 4B:
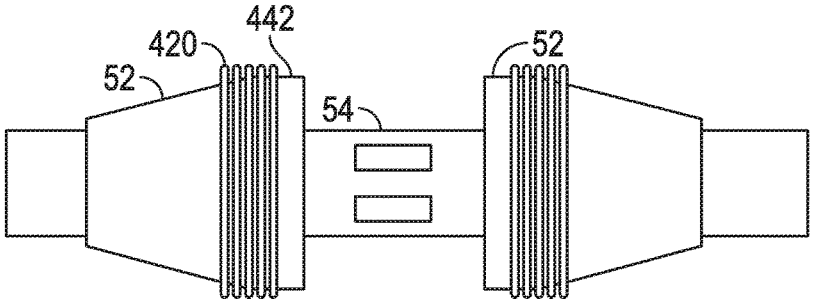

FIG. 4B shows another embodiment of the isolator 50 in accordance with the present disclosure. In FIG. 4B, the isolator 50 has one or more wear elements 420 disposed on a mandrel 54. For example, the isolator 50 may use wear elements 420 to prevent the deterioration of the isolator members 52. The wear elements 420 may provide wear resistance and/or seal adjustability. The wear elements 420 may be springs, split rings, flexible coils, shear rings, wear pads or similar circular adjustable mechanisms. The wear elements 420 may expand from a first diameter during run-in to a second larger diameter during operation. A smaller run-in diameter may be desired to prevent the isolator 50 getting stuck while running the isolator 50 via the conveyance device 20. A larger diameter may be needed during the operation of the isolator 50 to restrict fluid exit from the testing volume 34 into the adjacent bores 30 and 36.

Figure 4C:
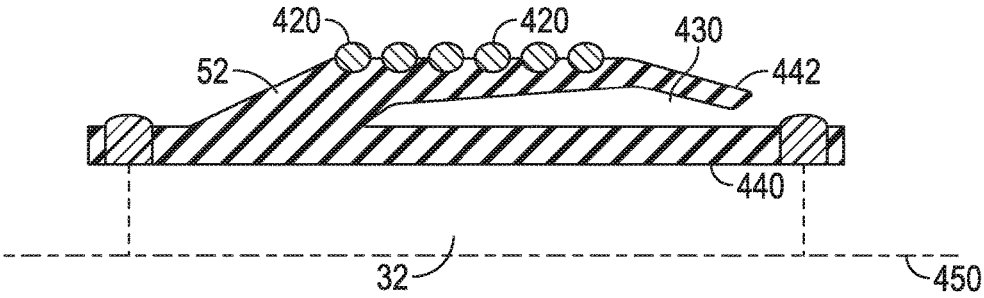

FIG. 4C illustrates yet another embodiment of the isolator 50 that has an adjustable outer diameter. The isolating element 52 can be actuated by hydraulic means to increase the outer diameter of the isolator 50. The isolating element 52 has a lip 442, a base 440, and an inflation chamber 430. The testing fluid from the testing volume 34 or other source fills the inflation chamber 430. The pressure in the inflation chamber 430 extends the lip 442 diametrically outward, and the lip 442 seals against inner surface 12 of the casing 10. As we discussed above, the seal does not have to be a perfect seal. During the run-in, the lip 442 is diametrically retracted and during the operation the lip 442 is extended out diametrically.

Optionally, wear elements 420 may be used to keep the lip 442 retracted while run-in. Therefore, in addition to providing a wear surface, the wear elements 420 keep the lips 442 from extending outwards by applying compressive force. In this embodiment, the wear elements 420 are released above a pressure that overcomes the compressive force of the wear elements 420.

In some embodiments, the inflation chamber 430 is formed between the base 440 and the lip 442. Optionally, the base 440 is attached to the mandrel 54. Then, the testing volume 34 forms between the lip 442 and the mandrel 54 and without the base 440.

Figure 5:
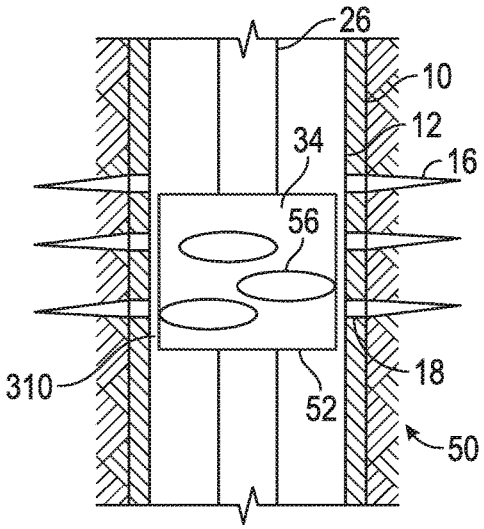
FIG. 5 illustrates an exemplary isolator that uses one isolating member.

It should be understood that multiple isolating members 52 are not required to form the testing volume 34. FIG. 5 shows another embodiment of the isolator 50 that encloses the testing volume 34 in a compartment-shaped isolating element 52. As a result, the seal forms between the outer surface 58 of the isolator 50 and the inner surface 12 of the casing 10. The testing volume 34 is inside the isolating element 52. The testing fluid from the flow bore 26 pressurizes the testing volume 34. The testing volume 34 has the ports 56 that face the inner surface 12 of the casing 10. The ports are located on the outer surface 58 of the isolator 50. During the operation, when the ports 56 form a fluid connection with the flow paths 18 pressure drops as previously described.

From above, it should be appreciated that the isolator 50 according to the present disclosure form a testing volume 34 that may be used to detect flow paths 18 in the wellbore. Also, the test devices described above may be used with a fluid source and one or more pressure sensors.

The conveyance device 20 is fluidly connected to one or more pumps, or other fluid mover (not shown) preferably located at the surface, which moves the testing fluid through the flow bore 26 into the testing volume 34. The testing volume 34 may be in pressure communication with one or more pressure sensors 62 located at the surface near or at the pump (not shown), in the flow bore 32 (shown in FIG. 1A) or in the testing volume 34 (shown in FIG. 7A) provide testing fluid pressure data. By pressure communication it is meant that pressure changes in the testing volume 34 can be directly or indirectly estimated by the pressure sensors 62. The sensor 62 measures the pressure in the flow bore 26. In another embodiment, the sensor 62 may be located downhole in the bottom hole assembly. For example, the sensor 62 may be coupled to the isolating element 52, the mandrel 54 or the conveyance device 20. The sensor 62 may measure the pressure of the testing volume 34 or the adjacent bores 30 or 36. The sensor 62 may provide differential pressure relative to the wellbore. The sensor 62 may send the signals real time to a surface control unit, a downhole control unit or a downhole memory module.

In one mode of use, where there is a certain amount of drift, the fluid is continuously pumped into the testing volume. During operation, the pressure sensors 62 send a pressure that represents the pressure in the testing volume 34. It should be noted that the pressure sensors 62 need not measure the actual pressure within the testing volume 34.

Figure 6:
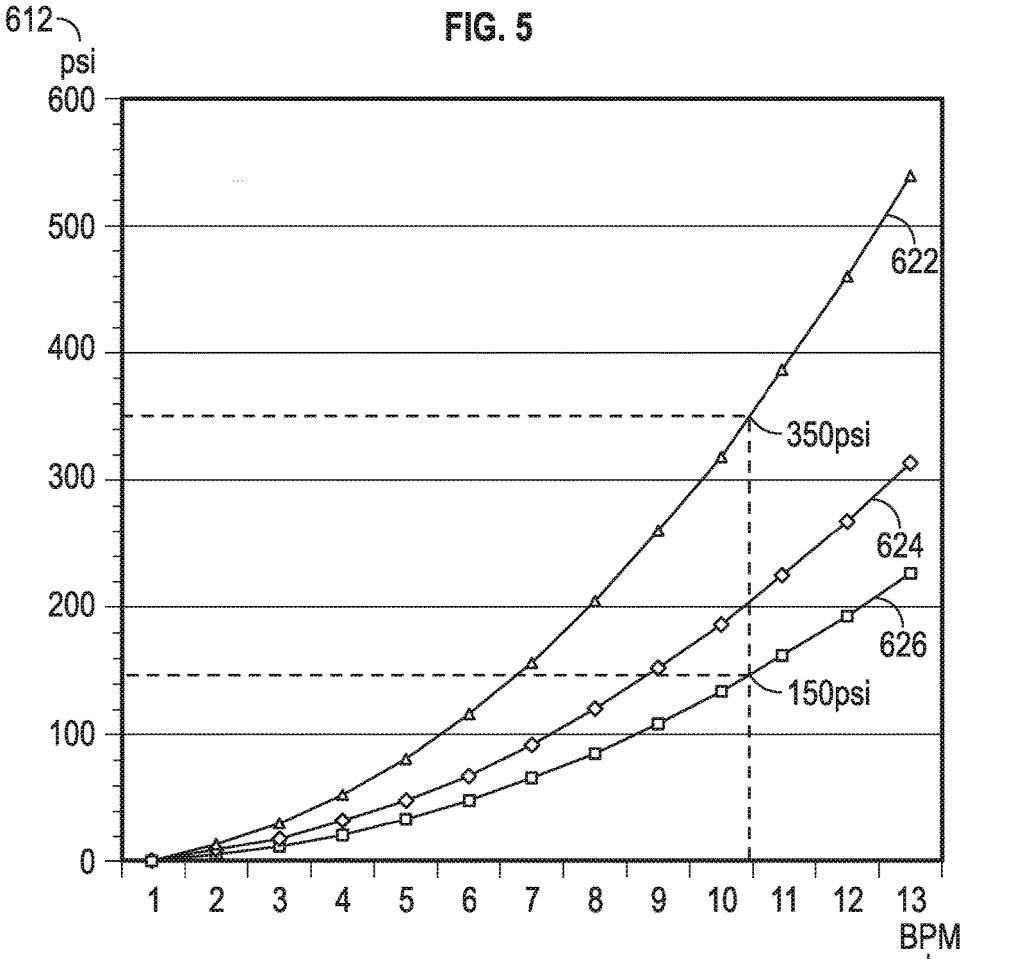
FIG. 6 shows predicted pressure curves for the testing volume associated with an isolator.

FIG. 6 shows predicted pressure curves for the testing volume 34 that encounters flow paths 18 in a wellbore. The curves are based on the pressure variances of the testing volume 34 along the wellbore tubular 10 with respect to fluid flow rates. The horizontal axis 610 of FIG. 6 shows the pump rate in barrels per minute (BPM). The vertical axis 612 is the pressure of the testing volume 34 in psi. An example of the testing volume 34 is formed by the isolator 50 and the casing 10 with ¼ inch diametrical drift. The casing 10 has 4¼ inch outer diameter, 3.75 inch inner diameter and 16.6 pounds per feet weight per length. The sensor 62 estimates the pressure of the testing volume 34. Three curves: 622, 624 and 626 display the estimations. The curve 622 demonstrates the pressure at the locations 142 or 146 when the isolator 50 does not face the flow paths 18. The curve 626 occurs when the isolator 50 faces the flow paths 18. An operator monitors the pressure drop demonstrated by the curve 624. For example, at 10 BPM pump rate, the pressure in the testing volume 34 is 350 psi when no flow path 18 is experienced. At the same pump rate, when the testing volume 34 encounters flow paths 18, the pressure is 150 psi. The operator will see a pressure drop of 200 psi.

It should be appreciated that values in FIG. 6 are provided with specificity merely for convenience and that the present invention is by no means limited to these values. Furthermore, it should be understood that these values are subject to applicable fluid type, flow rate, casing size, number of flow paths and sizes and the drift. Thus, these values merely indicate the general fluid transfer formulas that may be applied to depict pressure under given well constraints. It is believed that the general relationships between the conduits, pipes and the isolator 50 will enhance the pressure variance even at a large drift utilizing an exemplary isolator 50 according to the embodiments of the present invention.

Figure 7A:
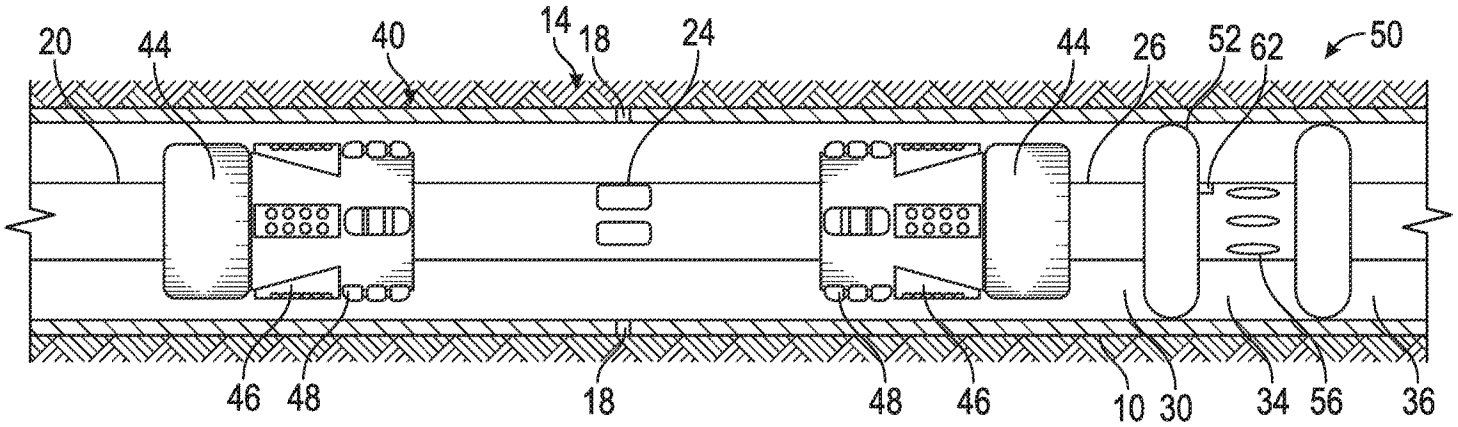
FIGS. 7A-7B illustrate an exemplary isolator used with a well treatment tool.

The test device according to the present disclosure can be used for various well treatment operations. The well treatment operation includes well cleaning, hydraulic fracturing, acidizing, cementing, plugging, pin point tracer injection or other well stimulation or intervention operations. The use of test devices according to the present disclosure is explained below in connection with hydraulic fracturing operations FIG. 7A represents the isolator 50 and a well treatment tool 40 disposed along the conveyance device 20. In an exemplary fracing operation, the test device is moved through the casing 10 while the pressure sensor 62 estimates pressure in the testing volume 34. The well treatment tool 40 uses packing elements 44 to hydraulically isolate the treatment zone 14 and inject fluid into the treatment zone 14 for the fracing job. The well treatment tool 40 has openings 24 to discharge the frac fluid. The openings 24 are aligned with the flow paths 18 or the zone 14 when the treatment tool 40 is moved a fixed distance. The well treatment tool 40 receives the frac fluid via the flow bore 32 and discharges the frac fluid through openings 24. The isolator 50 that forms the testing volume 34 is located at a fixed distance from the well treatment tool 40.

In one method of use, during the operation mode, the conveyance device 20 moves the isolator 50 and the well treatment tool 40, preferably up the wellbore, shown with arrow 22 in FIG. 1A, or in the downhole direction. The pressurized testing fluid is pumped down through the flow bore 32 into the testing volume 34 from the surface via the conveyance device 20. The operator monitors the pressure of the testing volume 34. As described previously, this pressure can be measured directly or indirectly by pressure sensor 62. Optionally, the pressure may be recorded downhole or at the surface. The operator may extract the data from the recordings. As long as the isolator is in an unperforated section of the wellbore, the operator observes a substantially non-varying pressure output such as the lines 222 or 226 of FIG. 2.

When the isolator 50 reaches a section of the casing 10 that has the flow paths 18, the testing fluid in the testing volume 34 escapes into the flow paths 18. This generates a measurable pressure drop in the testing volume 34 (for example, curve 224). Therefore, the operator has at least a preliminary indication that the flow path 18 is present. In one example, the flow paths 18 are perforations formed by a perforation gun in a prior job. Optionally, the operator may take steps to verify the presence of the flow paths 18. For instance, the pressure drop may be compared to a well history. Alternatively, the isolator can be re-passed along the flow paths 18 to take additional measurements and to increase the confidence level.

The well treatment job may begin after the operator is confident that a flow path 18 has been identified. As described previously, the isolator 50 is disposed at a fixed distance from the well treatment tool 40. Therefore, the operator knows precisely how far the well treatment tool 40 can be displaced to bring the well treatment tool 40 in fluid communication with the flow paths 18. The testing volume 34 is moved away from the location identified by the flow paths 18 and the well treatment tool 40 is brought into fluid communication with the flow paths 18. After the well treatment tool 40 is positioned, the fracturing operation may commence.

According to the above arrangement, the isolator 50 is assembled adjacent to the well treatment tool 40 in the bottom hole assembly. Therefore, both the isolator 50 and the well treatment tool 40 run-in-hole together. Alternatively, the well treatment tool 40 may be deployed into the wellbore after the isolator 50 has been run-in-hole.

It should be appreciated that the described test device can help more precisely position the well treatment tool 40 with respect to the flow paths 18. The well treatment tool 40 has at least one packing element 44 located on the upper side of the zone 14 and at least one packing element 44 on the lower side of the zone 14. Therefore, the well treatment tool 40 seals the flow paths 18 from the other parts of the wellbore. Greater precision in positioning allows the distance between the packing elements 44 of the well treatment tool 40 to be closer to each other. Smaller distance between the packing elements 44 may result in operational benefits such as lesser amount of treatment fluid occupying the well treatment tool 40, the pump working at lower pressures, less proppant build up, etc.

Figure 7B:
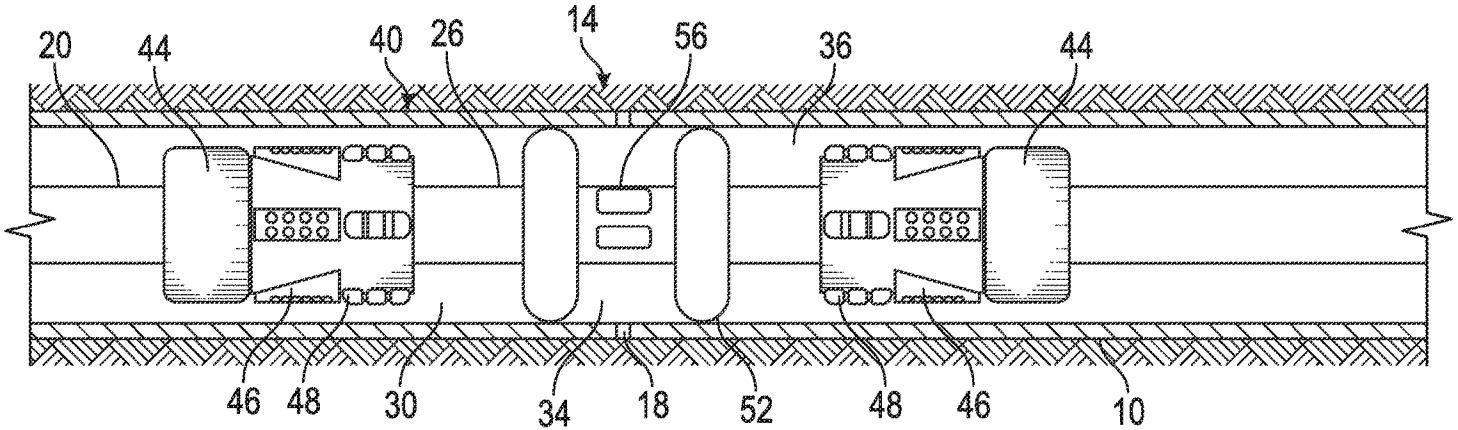

Referring to FIG. 7B, another embodiment is shown, where the isolator 50 does not need to be moved after detecting the flow paths 18. Therefore, the hydraulic fracturing can commence immediately after the detection of the flow paths 18 without any movement of the well treatment tool 40. FIG. 7B shows an illustrative embodiment in which the isolator 50 is disposed inside the well treatment tool 40 between the packing elements 44. Here, the ports 56 may allow the treatment fluid discharge to treat the zone 14. Alternatively, the well treatment tool 40 may have additional openings to deliver the treatment fluid. Alternatively, the components of the well treatment tool 40 may be used as the isolating elements 52. Optionally, the isolator 50 may be located on the uphole or downhole direction of the well treatment tool 40. In alternative embodiments to the present invention, the treatment fluid may be used as the testing fluid.

The treatment fluid can be directed into the isolator 50 or the well treatment tool 40 selectively via valve actuators well know in the art. The isolator 50 and/or the well treatment tool 40 may be activated by mechanical actuators, J-slot mechanisms, hydrostatic fluid pressure or hydraulic control lines and seated ball valves, other ball valves, check valves, choke valves, butterfly valves, poppet valves, shear mechanisms, servo valves, other electronic controls etc. The flow of the testing fluid or the treatment fluid can be directed via similar well-known arrangements.

In a pinpoint tracer application, a tracer logging tool or the isolator 50 injects a tracer fluid into the flow paths 18 after the isolator 50 locates the flow paths 18. The tracer fluid has at least one property that can be detected by the tracer logging tool. The tracer logging tool measures the conductivity of the flow paths 18. The conductivity is a characteristic of the flow space of the flow paths 18 and is affected by the volume, depth, area, etc. of the flow paths 18. Conductivity represents how easily the tracer fluid flows into and/or through the flow paths 18. The tracer fluid may be composed of water, borax, chlorine, sodium borate, sodium tetraborate, disodium tetraborate, iodine, hydrogen, nitrogen, fluorine, phosphorus, technetium, antimony, bromine, iridium, scandium, manganese, sodium, silver, argon, and xenon. Alternatively, the tracer logging tool may measure conductivity as the isolator 50 locates the flow paths 18.

Alternatively or additionally, the isolator 50 may perform well cleaning operations. The cleaning fluid may be injected through the testing volume 34. Optionally, the cleaning fluid may be provided through the well treatment tool 40. For example, the isolator 50 may have two operation conditions: one condition for restricted fluid flow in the flow bore for expanding the isolating members 52 and a second condition of unrestricted flow for cleaning the well. For such a tool, a hydraulic J mechanism may be used to actuate the isolating members 52, which may be straddle packers. This configuration may be used when the isolator 50 is between the straddle packers.

Figure 8A:
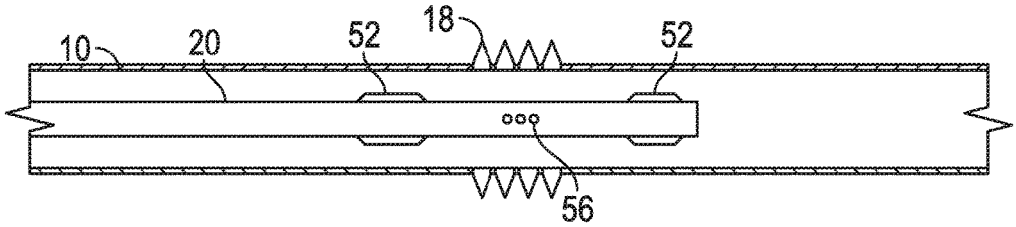
FIGS. 8A-8B illustrate an exemplary isolator in run-in position and expanded position, respectively.
Figure 8B:
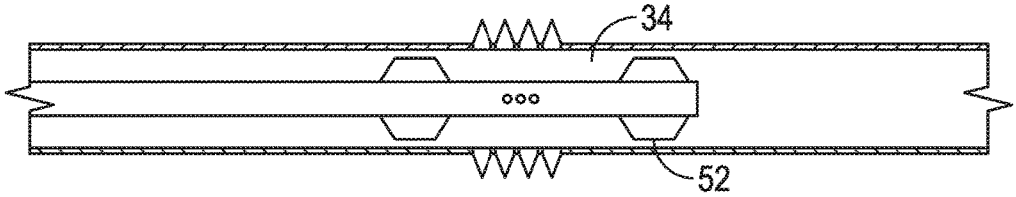
Figure 9A:
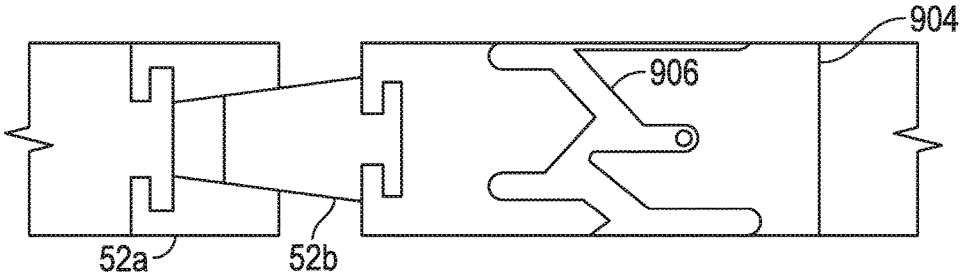
FIGS. 9A-9B illustrate an exemplary isolator and drive mechanism in run-in position and expanded position, respectively.
Figure 9B:
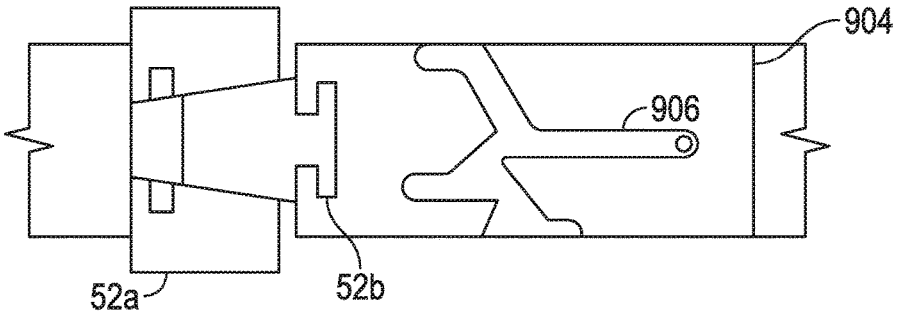

Referring to FIG. 8A, the isolator 50 is shown in the run-in position where the isolating members 52 are retracted. FIG. 8B shows the isolating members 52 in an expanded position, therefore, forming the testing volume 34. FIGS. 9A and 9B show the J-slot mechanism 906 and a drive piston 904 that actuates the isolating members 52 and shifts them to the expanded position. FIG. 9A corresponds to FIG.

Figure 10A:
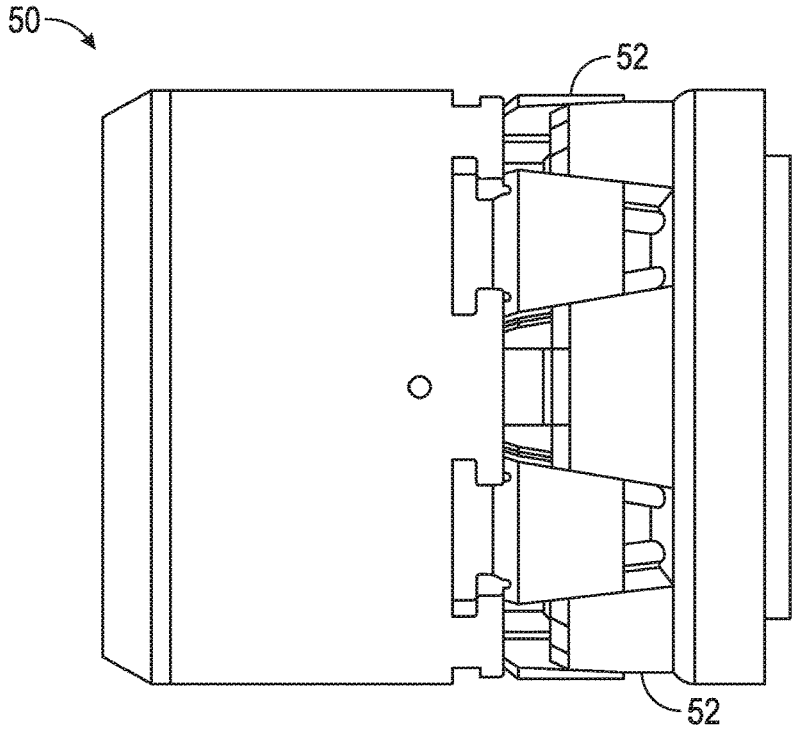
FIGS. 10A-10B illustrate an exemplary isolating member in run-in position and expanded position, respectively.
Figure 10B:
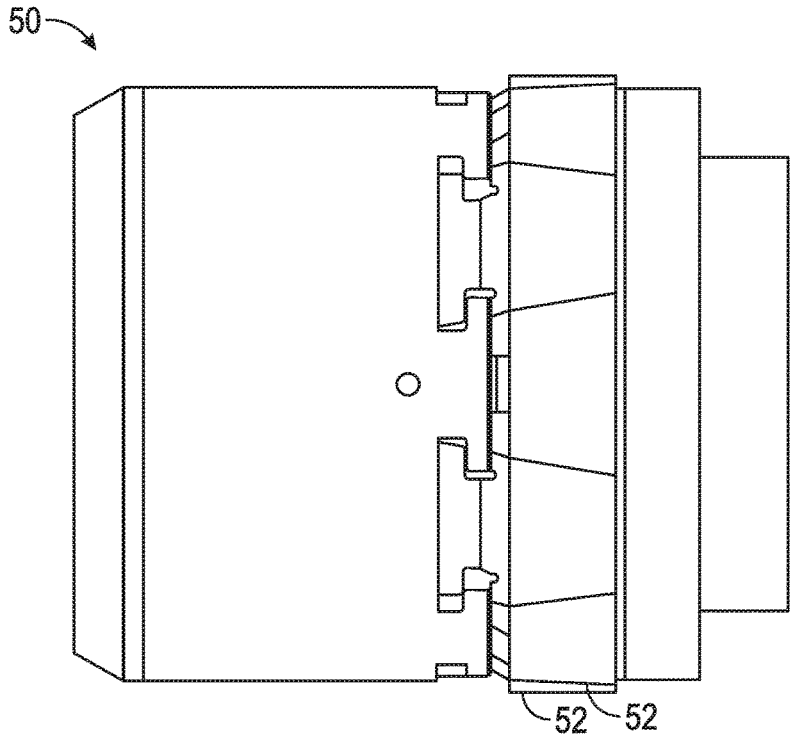

8A and FIG. 9B corresponds to FIG. 8B. In FIG. 10A, the isolating members 52 are shown as collets or dogs that are separated apart from each other. In expanded position, the isolating members 52 approach each other and increase the outer diameter 58.

The foregoing description is directed to particular embodiments of the present disclosure for the purpose of illustration and explanation. It will be apparent, however, to one skilled in the art that many modifications and changes to the embodiment set forth above or embodiments of different forms are possible without departing from the scope of the disclosure. It is intended that the following claims be interpreted to embrace all such modifications and changes.

We claim:

1. An apparatus for performing a downhole operation, comprising:

a conveyance device having a flow bore;

an isolator forming a testing volume at least partially defined by an inner surface of a wellbore tubular;

at least one pressure sensor generating signals representative of a pressure in the testing volume while the conveyance device moves the isolator axially through the wellbore tubular; and a source supplying a testing fluid to the testing volume at least at a flow rate that generates a pressure variance indicating fluid flow into at least one flow path in the wellbore tubular while the testing volume is moving and while allowing a portion of the testing fluid to flow through a predetermined clearance between the isolator and the inner surface of the wellbore tubular.

2. The apparatus of claim 1, wherein the isolator has an adjustable outer diameter, the outer diameter expanding from a first diameter during run-in to a second larger diameter during operation.

3. The apparatus of claim 2, wherein the isolator includes at least one of: (i) an actuator adjusting the outer diameter of the isolator, and (ii) an actuator controlling fluid flow into the testing volume.

4. The apparatus of claim 3, wherein the actuator includes at least one of a J-slot mechanism, diaphragm, sleeve, valve, and expendable material.

5. The apparatus of claim 1, wherein the isolator includes:

a mandrel having at least one opening providing fluid communication between the flow bore and the testing volume; and a first and a second isolating element disposed on the mandrel, wherein the testing volume is formed between the first and the second isolating element.

6. The apparatus of claim 5, wherein the first and the second isolating elements are selected from at least one of: (i) a fixed cone, (ii) an expandable cone, (iii) a ring, (iv) a swab cup, (v) a packer, (vi) a cylindrical compartment, (vii) collets, and (viii) dogs.

7. The apparatus of claim 1, wherein the isolator includes an outer circumferential surface that includes at least one wear pad.

8. The apparatus of claim 1, wherein the conveyance device is at least one of (i) a tubing, (ii) coiled tubing, (iii) drillpipe, (iv) wireline, (v) slickline, and (vi) electric line; and further comprising:

a fluid mover configured to supply the testing fluid to the testing volume via the conveyance device while the isolator moves axially through the wellbore tubular.

9. The apparatus of claim 1, wherein the at least one pressure sensor includes at least one of: (i) a pressure sensor at a fluid mover supplying the testing fluid, (ii) a pressure sensor at a downhole location, (iii) a pressure sensor at a surface location, (iv) a pressure sensor sending signals to a surface location, and (v) a pressure sensor sending signals to a memory module located at the downhole location.

10. The apparatus of claim 1, further comprising a well treatment tool disposed along the conveyance device at a fixed distance to the testing volume.

11. The apparatus of claim 10, wherein the well treatment tool receives a treatment fluid via the flow bore.

12. The apparatus of claim 11, wherein the treatment fluid is a tracer, and wherein the well treatment tool comprises a tracer logging tool configured to measure a conductivity of at least one flow path in a treatment zone using the tracer.

13. The apparatus of 10, wherein the well treatment tool includes at least a pair of zone isolation members defining a treatment zone.

14. A method of performing a downhole operation, comprising:

forming a testing volume in a wellbore using an isolator, the testing volume being at least partially defined by an inner surface of a wellbore tubular, the isolator being separated from the inner surface by a predetermined clearance;

moving the testing volume along the wellbore;

supplying a testing fluid to the testing volume at least at a flow rate that generates a pressure variance indicating fluid flow into at least one flow path of the wellbore tubular while the testing volume is moving and while allowing a portion of the testing fluid to flow through the predetermined clearance; and identifying a location of the at least one flow path by estimating a pressure of the testing fluid in the moving testing volume.

15. The method of claim 14, wherein the pressure indicative of a testing volume pressure is measured at at least one of: (i) a surface location, and (ii) a downhole location.

16. The method of claim 14, further comprising performing a well treatment operation after identifying the location of at least one flow path.

17. The method of claim 16, further comprising comparing the identified location with a well history before performing the well treatment operation.

18. The method of claim 16, wherein the well treatment operation is at least one of: (i) a hydraulic fracturing operation, (ii) a well stimulation operation, (iii) a well tracer injection operation, (iv) a well intervention operation, and (v) a well cleaning operation.

19. The method of claim 16, further comprising positioning a well treatment tool used during the well treatment operation with reference to the identified location.

* * * * *